United States Patent [19]

Debande

[11] 4,392,948

[45] Jul. 12, 1983

[54] PROCESS FOR REMOVING THE NITROGEN IMPURITIES FROM A HYDROCARBON MIXTURE

[75] Inventor: Guy F. S. Debande, Brussels, Belgium

[73] Assignee: Labofina, S.A., Brussels, Belgium

[21] Appl. No.: 318,408

[22] Filed: Nov. 5, 1981

Related U.S. Application Data

[63] Continuation-in-part of Ser. No. 155,722, Jun. 2, 1980, abandoned.

[30] Foreign Application Priority Data

Jul. 6, 1979 [LU] Luxembourg ..... 81472

[51] Int. Cl.[3] ..... C10G 31/08; C10G 17/06

[52] U.S. Cl. ..... 208/254 R; 208/254 H

[58] Field of Search ..... 208/254 R, 254 H

[56] References Cited

U.S. PATENT DOCUMENTS

| | | | |
|---|---|---|---|
| 3,177,137 | 4/1965 | Gordon et al. | 208/224 |
| 3,719,587 | 3/1973 | Karchmer et al. | 208/208 R |
| 4,071,435 | 1/1978 | Smith | 208/91 |
| 4,159,940 | 7/1979 | Smith | 208/254 H |
| 4,271,009 | 6/1981 | Stover et al. | 208/254 R |
| 4,272,361 | 6/1981 | Compton | 208/254 R |
| 4,330,392 | 5/1982 | Bearden, Jr. et al. | 208/10 |

*Primary Examiner*—Delbert E. Gantz
*Assistant Examiner*—O. Chaudhuri
*Attorney, Agent, or Firm*—J. D. Evans

[57] ABSTRACT

Process for removing the nitrogen impurities from a liquid hydrocarbon mixture comprising introducing into a low volume mixer the hydrocarbons to be treated together with a dilute aqueous acid solution to form an emulsion, withdrawing said emulsion into a decantation zone where it breaks and recycling to the low volume mixer from 80 to 95% by volume of the aqueous acid solution coming from the decantation zone, so as to maintain in said low volume mixer a volume ratio of the hydrocarbons to the aqueous acid solution from about 0.3 to about 13, preferably from about 0.5 to about 4, and the pH of the aqueous acid solution from about 0.1 to about 1.5.

14 Claims, No Drawings

PROCESS FOR REMOVING THE NITROGEN IMPURITIES FROM A HYDROCARBON MIXTURE

This application is a continuation-in-part of co-pending U.S. patent application Ser. No. 155,722, filed June 2, 1980, and now abandoned.

BACKGROUND OF THE INVENTION

The present invention relates to an improved process for removing nitrogen impurities, by means of an aqueous acid solution, from a liquid hydrocarbon mixture. More particularly, the present invention relates to the treatment of a liquid hydrocarbon mixture containing unsaturated hydrocarbons with an aqueous acid solution.

Generally, in order to remove aromatic compounds therefrom, liquid hydrocarbon mixtures are subjected to treatments such as hydrogenation or reforming. However, it is well known that the catalysts used in the hydrogenation treatments, which are most frequently a noble metal on a support, or the catalysts used in the reforming, are poisoned by the nitrogen compounds which are present in the liquid hydrocarbon mixtures. One of the required conditions for subjecting a hydrocarbon feed to a reforming process, is a nitrogen compound content lower than 0.5 ppm. Indeed, the presence of nitrogen compounds in a hydrocarbon feed which is to be reformed gives rise to the formation of $NH_3$ which may be either adsorbed at the catalyst level, with the resulting neutralization of the acid sites, or recombined with HCl formed during the reforming, with formation of a salt which forms a deposit on the apparatus.

For the most part, the nitrogen compounds contained in the hydrocarbon feeds are present in the form of basic nitrogen compounds. In order for the hydrocarbon mixtures to be suitable for reforming or for subjecting to a hydrogenation treatment in the presence of a noble metal catalyst, the basic nitrogen compound content must be reduced to less than 2 ppm and preferably to less than 1 ppm. The rest of the nitrogen compounds, inasmuch as their content does not exceed 10 ppm, may readily be eliminated by hydrogenation under operating conditions similar to those of a desulfurization.

If the basic nitrogen compound content is not reduced to less than 2 ppm, the residual basic nitrogen compounds will have to be eliminated by hydrogenation under severe conditions, and particularly under a high hydrogen partial pressure. Such conditions are difficult to use in conventional refineries.

In order to avoid these drawbacks, it has been proposed to treat with an organic or inorganic acid those hydrocarbon feeds which have a boiling point of from 200° to 600° C., and which have to be further submitted to a thermal or catalytic cracking to form gasolines. However, the nitrogen compounds are only partially removed by this acid treatment, and therefore, when the hydrocarbon feed is cracked, nitrogen compounds are still formed, and these have to be removed before carrying out the reforming. Moreover the operating conditions of the acid treatment of the hydrocarbon feed before cracking are not suitable for use with the cracked products.

Indeed, the cracked products contain unsaturated hydrocarbons which can polymerize if they are submitted to an acid treatment under the conditions suggested for the acid treatment before cracking. The polymerization of these unsaturated hydrocarbons depends on the acid concentration of the solution and on the contact time of the feed with the acid solution. The conditions of the acid treatment of the feed before cracking are an acid concentration of from 85 to 100% and contact times of from 5 minutes to 2 hours. Under such conditions, the unsaturated hydrocarbon present in the feed will polymerize.

It has been proposed to directly treat the cracked products with an acid solution, particularly a sulfuric acid solution, but under specific conditions of acid concentration and contact time. Thus it has been proposed in "The Science of Petroleum", Vol. III, page 1773 to use an aqueous sulfuric acid solution, having an acid concentration of from 40 to 98% with contact times such that the lower the acid concentration, the higher the contact time. Nevertheless, the polymerization of the unsaturated hydrocarbons cannot be completely avoided, even if the acid concentration is as low as 40%.

In order to reduce the contact time, and therefore the polymerization rate, it has been proposed to use more concentrated sulfuric acid solutions, but using certain specific methods of contacting the feed with the sulfuric acid solution. Examples of contacting devices, which have been suggested are mixer batteries wherein the feed and the concentrated sulfuric acid solution move in countercurrent flow, and a contacting column having a particular contact bed described in the U.S. Pat. No. 2,999,807. According to the process described in this U.S. patent, one uses an aqueous sulfuric acid solution having an acid concentration of at least 65% together with contact times in the column of from 3 to 25 seconds. This column includes a contact bed made of an inert material which may be a ceramic, coke or glass having a hydrophilic surface so that it is easily wetted by the sulfuric acid which is thereby retained on the surface, with formation of a large contact surface. However, this process does not avoid the formation of a significant amount of polymerized products.

Another process for acid treatment of hydrocarbons is disclosed in U.S. Pat. No. 3,177,137 in which hydrocarbon droplets are dispersed in a strong acid, such as 98% sulfuric acid, and a supernatant layer of clear, acid-free hydrocarbon is formed above the dispersion. Spent acid may be recycled, but the amount must be restricted to produce a quality product. Large amounts of acid are consumed in the process.

U.S. Pat. No. 3,719,587 discloses a process for treating coal-derived naptha by purging with an inert gas and washing the hydrocarbon by passing it together with water or a dilute acid through a centrifugal pump or orifice mixer and then allowing the resulting mixture to separate in a settling zone. If the amount of treated feed and the amount of used aqueous solution which must be disposed of are taken into account, it is apparent that not only the amount of consumed acid is not negligible, but also the amount of used aqueous solution to be neutralized before disposal requires the use of suitable purification plants.

SUMMARY OF THE INVENTION

Accordingly, it is the object of the present invention to provide an improved process for removing nitrogen impurities from a mixture of liquid hydrocarbons by treatment with an aqueous solution of an organic or an inorganic acid.

It is also an object of the present invention to provide a process for removing nitrogen impurities from a liquid hydrocarbon mixture which does not induce substantial polymerization of unsaturated hydrocarbons in the hydrocarbon mixture.

A further object of the present invention is to provide a process for removing nitrogen impurities from a liquid hydrocarbon mixture which produces a hydrocarbon product which does not require subsequent hydrodesulfurization to be effected under severe conditions for complete removal of nitrogen impurities.

An additional object of the present invention is to provide a process for removing nitrogen impurities from a liquid hydrocarbon mixture which produces a hydrocarbon mixture with a reduced tendency to poison noble metal catalysts.

Yet another object of the present invention is to provide a process for removing nitrogen impurities from a liquid hydrocarbon mixture wherein the hydrocarbon mixture is contacted by a dilute aqueous acid solution for a very short period of time.

Still another object of the present invention is to provide a process for removing nitrogen impurities from a liquid hydrocarbon mixture which effectively utilizes dilute aqueous acid solutions.

It is also an object of the present invention to provide a process for removing nitrogen impurities from a liquid hydrocarbon mixture which does not consume large amounts of acid.

Additionally, it is an object of the present invention to provide a process for removing nitrogen impurities from a liquid hydrocarbon mixture which reduces the amount of spent acid which must be treated and disposed of.

Another object of the present invention is to provide an improved process to remove the nitrogen impurities from a liquid hydrocarbon mixture by means of an aqueous acid solution, according to which the major part of the aqueous acid solution is recycled.

Another object of the present invention is to provide a process for removing nitrogen impurities from a liquid hydrocarbon mixture which can be carried out more economically than prior art processes.

These and other objects of the invention are achieved by providing a process for removing nitrogen impurities from a mixture of liquid hydrocarbons comprising continuously introducing a dilute aqueous solution of an organic or inorganic acid into a low volume mixer, said solution having an acid concentration of from 0.01 to 5 volume percent, continuously introducing the liquid hydrocarbon mixture into said mixer, the volume ratio of the amount of liquid hydrocarbon to the amount of aqueous acid solution being from about 0.3 to about 13, forming in the mixer an emulsion of the hydrocarbon mixture in the aqueous acid solution by mixing the hydrocarbon mixture and the acid solution during a period of time not exceeding 2 seconds, thereby extracting the major part of the nitrogen impurities, withdrawing the resultant emulsion into a decantation zone where the emulsion breaks and phase separation occurs, recovering a hydrocarbon phase containing not more than 2 ppm of basic nitrogen impurities from the decantation zone, recycling from about 80 to 95 volume percent of the used aqueous acid solution phase to the low volume mixer, withdrawing the remainder of the used aqueous acid phase as a purge, and adding a sufficient volume of fresh acid solution to the recycle acid to maintain the volume ratio of the liquid hydrocarbon mixture to the aqueous acid solution in the low volume mixer at its initial value, the concentration of the fresh acid solution being such that the pH of the aqueous acid solution is being 0.1 and 1.5.

DETAILED DESCRIPTION OF THE PREFERRED EMBODIMENTS

According to the invention, basic nitrogen compounds contained in the liquid hydrocarbon mixtures are almost completely eliminated, by contacting said mixtures with a dilute aqueous solution in a low volume mixer, in order to form an emulsion which is withdrawn into a decantation zone where the emulsion breaks practically immediately. This process is advantageous, because only dilute aqueous acid solutions are used. The acid concentration is considerably reduced compared to prior processes. Further, the amount of acid consumed and the amount of waste acid which requires treatment prior to disposal are reduced by recycling all but a small portion of the used acid recovered from the decantation zone.

The process of the invention is applicable to a wide range of liquid hydrocarbon mixtures, and particularly to hydrocarbons having a boiling point from 30° to 300° C.

The process of the invention is particularly applicable to liquid hydrocarbon mixtures obtained from straight run distillates, and more particularly to liquid hydrocarbon mixtures, containing unsaturated hydrocarbons, boiling in the gasoline range and obtained by thermal or catalytic cracking of heavier hydrocarbons. The liquid hydrocarbon mixtures obtained from straight run distillates are generally constituted of kerosenes or white-spirits having a boiling point in respective ranges of from 150° to 290° C. and from 150° to 200° C. These hydrocarbon mixtures contain from 20 to 30 ppm of nitrogen compounds including from about 10 to 17 ppm of basic nitrogen compounds, and thus they are not suitable to be submitted to a hydrogenation in the presence of noble metal catalyst.

The liquid hydrocarbon mixtures obtained by thermal or catalytic cracking of heavier hydrocarbons contain unsaturated hydrocarbons and have a boiling point in the gasoline range. These liquid hydrocarbon mixtures contain generally from 50 to 60 ppm of nitrogen compounds including from 30 to 50 ppm of basic nitrogen compounds, and thus they are not suitable for direct submission to catalytic reforming.

When these hydrocarbon mixtures are treated according to the process of the invention, the basic nitrogen compound content of the feed is reduced to less than 2 ppm. The rest of the nitrogen compounds thereafter may be removed by a hydrogenation treatment under operating conditions similar to those of a desulfurization, in order to finally reach a nitrogen compound content of less than 0.5 ppm.

According to known methods for reducing the content of basic nitrogen compounds in such liquid hydrocarbon mixtures, the mixtures have to be treated with concentrated aqueous solutions of sulfuric acid, generally 40 to 98%, and during a period of from 3 to 30 seconds.

It has now been unexpectedly found that by use of the method of the present invention these liquid hydrocarbon mixtures can be treated with greatly diluted aqueous solutions of an inorganic or organic acid and during an extremely short period of time, i.e. less than 2 seconds. This is believed to be due to the formation of an emulsion of the hydrocarbon in the aqueous acid solution in the mixer.

It has now been found that the nitrogen compounds can be easily removed from the above-described hydrocarbon mixtures by treating these mixtures with an aqueous solution of an inorganic acid, having an acid concentration which may be as low as 0.01% by volume, but which is generally from 0.01 to 2.5% by volume, and with extremely short contact times, which do not exceed 2 seconds and may even be as low as 1 second or less.

When hydrocarbon mixtures containing unsaturated carbons are treated according to the operating conditions of the invention, it has been noticed that polymerized products are substantially not formed. The polymerized product content is determined in accordance with the ASTM D 381 method.

Recycling the major part of the used dilute aqueous acid solution enables considerable reduction of the acid consumption and avoids problems arising from the disposal of significant amounts of aqueous acid solution. Such results are only achieved, however, if the recycle is carried out under well defined operating conditions, in order to obtain a practically complete removal of the basic nitrogen compounds present in the hydrocarbons to be treated.

It has now been found that the reduction of the basic nitrogen compound content in hydrocarbon mixtures to a value lower than 2 ppm in accordance with the process of the present invention, mainly depends on the recycle volume of the used aqueous acid solution and on the pH of the aqueous acid solution present in the low volume mixer.

The recycle volume of the aqueous acid solution should be limited to a maximum of 95%. At higher recycle rates, there is an accumulation of products resulting from the reaction between the basic nitrogen compounds and the acid. Because the reaction between the nitrogen compounds and the acid is limited to an equilibrium, the accumulation of such products in the reaction mixture will promote the reverse reaction with the result that the basic nitrogen compound content will be maintained at a level higher than 2 ppm. On the other hand, for economic reasons, it is not advantageous to recycle less than 80% of the aqueous acid solution, because in this way, the amount of fresh acid which must be reintroduced into the mixture is increased.

It has also been observed that in order to obtain a suitable removal of the basic nitrogen compounds, the pH of the aqueous acid solution should be maintained between 0.1 and 1.5, preferably between 0.5 and 1. When the pH of the aqueous acid solution is higher than 1.5, the removal of the nitrogen compounds is no longer effectively performed. On the other hand, at a pH lower than 0.1, the nitrogen compound removal is not substantially improved, but the acid consumption is increased. The pH is maintained between said limits by introducing a suitable amount of fresh aqueous acid solution into the recycled used aqueous acid solution.

The amount of the additional fresh aqueous acid solution is chosen to maintain in the low volume mixer a liquid hydrocarbon mixture/aqueous acid solution ratio identical to the initial ratio. The volume ratio of the amount of hydrocarbon to the amount of dilute aqueous acid solution used in the process of the invention may vary from about 0.3 to about 13. It is preferred that said ratio be between 0.5 and 4 in order to provide a sufficient elimination of the nitrogen compounds, while maintaining an acceptable acid consumption. Indeed, if said ratio is higher than 4, the nitrogen compound extraction with dilute acid solutions may not be sufficient; thereby making it necessary to work at a lower pH and increasing the acid consumption. At lower ratios, the acid consumption, for the same pH, is higher.

According to an advantageous embodiment of the invention, from 90 to 93% by volume of the aqueous acid solution are recycled, the amount of the additional fresh aqueous acid solution being determined to maintain in the low volume mixer a pH of about 1 and a volume ratio between the hydrocarbons and the aqueous acid solution of about 1.

Either an inorganic acid or an organic acid may be used to carry out the process of the invention. Examples of suitable acids include hydrochloric acid, hydrobromic acid, hydrofluoric acid, hydroiodic acid, sulfuric acid, phosphoric acid, boric acid, fluorosulfuric acid, trifluoroacetic acid, trichloroacetic acid, formic acid, alkane sulfonic acids and alkylbenzene sulfonic acids. For reasons of easy availability, hydrochloric acid and sulfuric acid are preferred.

Examples of mixers which may be used in the process of the invention are centrifugal pumps and static mixers. Such mixers enable an emulsion of the hydrocarbons in the aqueous acid solution to form in a very short time. Moreover, said emulsion may be withdrawn substantially immediately after its formation. As a result, the contact time between the hydrocarbon mixture and the acid may be very short and the formation of significant amounts of polymerized products is avoided. It has unexpectedly been found that a substantially complete removal of the basic nitrogen compounds from the hydrocarbon mixtures can be achieved by means of the above-described mixers, while using a dilute aqueous acid solution.

In an advantageous embodiment of the process of the present invention, the aqueous acid solution and the hydrocarbon mixture are simultaneously introduced into the aspiration side of a centrifugal pump. The emulsion which is formed inside the pump is thereafter conveyed to a decanter wherein the rupture of the emulsion is substantially immediately achieved. The purified hydrocarbon mixture is then recovered from the upper part of the decanter, and the major part of the used aqueous acid solution is recycled to the low volume mixer.

Other types of mixers, such as a vessel fitted with a turbo-dispersor or a pulsed extraction column, could be used to form an emulsion of the contact liquids; however, these other types of mixers have various drawbacks. For example, the contact time is generally too long, or the emulsion formed is not sufficiently homogeneous. As a result, the amount of polymerized products is too high or the extraction of the basic nitrogen compounds is not sufficiently complete.

Further aspects of the invention will be apparent from a consideration of the following non-limiting examples.

EXAMPLE 1

At the aspiration side of a centrifugal pump there was simultaneously introduced:

- a hydrocarbon mixture, whose characteristics are indicated in Table I, having a total nitrogen compound content of 61.3 ppm including 43.3 ppm of basic nitrogen compounds, and an aqueous sulfuric acid solution having an acid concentration of 0.2% by volume.

The polymerized product content of the hydrocarbon feed was measured according to ASTM D-381 and was 7 mg per 1000 ml hydrocarbon.

TABLE I

| Feed Characteristics | |
|---|---|
| Distillation ASTM D 86 | |
| Initial point | 54° C. |
| End point | 203° C. |
| Specific gravity 15/4° C. | 0.793 |
| Composition | |
| Paraffins (Vol. %) | 27.5 |
| Olefins (Vol. %) | 33.0 |
| Naphthenes (Vol. %) | 3.5 |
| Aromatics (Vol. %) | 36.0 |

The volume ratio of the hydrocarbon mixture to the aqueous acid solution was 1/1.

The rotating speed of the pump was 1450 rpm.

Inside the centrifugal pump, both liquids were intimately mixed, and an emulsion of the hydrocarbon mixture in the aqueous acid solution was formed. The centrifugal pump pumped this emulsion to a decanter where breaking of the emulsion was substantially immediately achieved with formation of two phases: one phase containing the purified hydrocarbons located at the top of the container, and an aqueous phase at the bottom of the decanter.

The contact time between both liquids was estimated by the time required to pass through the centrifugal pump, i.e. 1 second.

The phase containing the hydrocarbons was analyzed to determine the nitrogen compound content, and the following results were obtained:

total nitrogen compound content: 8 ppm basic nitrogen compound content: 0.8 ppm polymerized product content: 15 mg/1000 ml hydrocarbon.

Thereafter a feed was prepared, which contained 75% by volume of naphtha and 25% by volume of the purified hydrocarbon mixture, and the feed was submitted to a desulfurization treatment under the following conditions:

usual desulfurization catalyst: 400 ml $H_2$ partial pressure: 12.5 kg/cm$^2$ total pressure: 25 kg/cm$^2$ temperature: 303.4° C.

hourly space velocity: 4 hr$^{-1}$ $H_2$/Hydrocarbon ratio: 150 N1/1.

No trace of nitrogen compounds was detected in the desulfurized hydrocarbon mixture.

By way of comparison, a feed was prepared containing 75% by volume of naphtha and 25% by volume of the hydrocarbon mixture which was not submitted to the acid treatment.

This feed was submitted to a desulfurization treatment under the same conditions as those hereabove described. After desulfurization, the feed had a nitrogen content of 5 ppm. This content was too high, and the desulfurized feed was still not suitable for catalytic reforming.

EXAMPLE 2

The process described in Example 1 was repeated, but using different hydrocarbon mixtures (whose characteristics are indicated in Table II), different acid concentrations and different volume ratios between the hydrocarbon mixture and the aqueous acid solution.

TABLE II

| Characteristics | Feed No. 2.1 | 2.2 | 2.3 | 2.4 |
|---|---|---|---|---|
| Distillation ASTM D 86 | | | | |
| Initial point (°C.) | 56 | 51 | 62 | 55 |
| End point (°C.) | 171 | 168 | 200 | 172 |
| Specific gravity 15/4° C. | 0.776 | 0.737 | 0.782 | 0.777 |
| Composition | | | | |
| Paraffins (vol. %) | 31.5 | 49 | 33 | 34 |
| Olefins (vol. %) | 36 | 43.6 | 34 | 34 |
| Naphthenes (vol. %) | 2.5 | 3.5 | 2 | 2 |
| Aromatics (vol. %) | 30 | 3.9 | 31 | 30 |

The operating conditions and the results are listed in Table III.

TABLE III

| Feed No. | Polymerized product content (mg/1000 ml) | Hydrocarbon/ $H_2O$ Ratio | $H_2SO_4$ concentration in water (% volume) | Basic nitrogen compound (ppm) | Total nitrogen compound (ppm) |
|---|---|---|---|---|---|
| 2.1 | 5 | | | 33.1 | 49.1 |
| 2.2 | 8 | | | 35.5 | 44.9 |
| 2.3 | 7 | | | 45.3 | 70.1 |
| 2.4 | 7 | | | 37.3 | 53.6 |
| 2.1 | 15 | 2 | 0.12 | 1.2 | 10.3 |
| 2.1 | 12 | 4 | 0.12 | 1.6 | 11.4 |
| 2.2 | 12 | 2 | 0.05 | 1.8 | 10.6 |
| 2.2 | 17 | 2 | 0.29 | 0.7 | 8 |
| 2.3 | 15 | 4 | 0.25 | 1.8 | 9.9 |
| 2.4 | 15 | 2 | 0.12 | 1.4 | 10.6 |

By way of comparison, the feed 2.2 was submitted merely to water treatment. In the treated product, 35.5 ppm of basic nitrogen compound were detected.

By way of comparison, the feed 2.2 was treated according to the above-described procedure but with an aqueous sulfuric acid solution having an acid concentration of 25% by volume. The volume ratio of the hydrocarbon mixture to the aqueous acid solution was 2. The polymerized product content of the treated hydrocarbon mixture was determined according to ASTM D-381, and a value of 80 mg/1000 ml was found, which is unacceptably high.

EXAMPLE 3

At the aspiration side of a centrifugal pump, there was simultaneously introduced:

a hydrocarbon mixture, whose characteristics are indicated in Table IV, having a total nitrogen compound content of 55.7 ppm including 39.2 ppm of basic nitrogen compounds, and an aqueous hydrochloric acid solution having an acid concentration of 0.5% by volume.

The initial polymerized product content of the hydrocarbon mixture, determined according to ASTM D-381 was 5 mg/1000 ml.

TABLE IV

| Feed Characteristics | |
|---|---|
| Distillation ASTM D 86 | |
| Initial point | 55° C. |
| End point | 175° C. |
| Specific gravity 15/4° C. | 0.782 |
| Composition | |
| Paraffins (vol. %) | 34 |
| Olefins (vol. %) | 36 |
| Aromatics (vol. %) | 30 |

The volume ratio of the hydrocarbon mixture to the aqueous acid solution was 0.5.

The rotating speed of the pump was 1450 rpm.

Both liquids were intimately mixed inside the centrifugal pump, and an emulsion of the hydrocarbon mixture in the aqueous acid solution was formed. The centrifugal pump pumped this emulsion to a decanter wherein breaking of the emulsion is substantially immediately achieved with formation of two phases.

The contact time between the two liquids was estimated by the time required to pass through the centrifugal pump, i.e. 1 second.

The nitrogen compound content of the phase containing the hydrocarbon mixture was as follows:

Total nitrogen compound content: 8.6 ppm

Basic nitrogen compound content: 0.9 ppm

The polymerized product content, according to ASTM D-381 was 15 mg/1000 ml.

The run was continued as described in Example 1, and the desulfurized feed did not contain any trace of nitrogen compound.

EXAMPLE 4

At the inlet of a static mixer having a diameter of 4 cm and a length of 75 cm, there was simultaneously introduced:

- a hydrocarbon mixture, whose characteristics are indicated in Table V, having a total nitrogen compound content of 54.4 ppm including 43.4 ppm of basic nitrogen compounds, at a rate of 0.85 $m^3$/hour, and
- an aqueous sulfuric acid solution having an acid concentration of 0.5% by volume at a rate of 1.7 $m^3$/hour.

The initial polymerized product content of the hydrocarbon mixture, according to ASTM D-381, was 8 mg/1000 ml.

TABLE V

| Feed Characteristics | |
|---|---|
| Distillation ASTM D 86 | |
| Initial point | 60° C. |
| End point | 184° C. |
| Specific gravity 15/4° C. | 0.767 |
| Composition | |
| Paraffins (vol. %) | 32 |
| Olefins (vol. %) | 36 |
| Aromatics (vol. %) | 30 |
| Naphthenes (vol. %) | 2 |

The contact time in the static mixer was about 1 second.

Both liquids were intimately mixed in the static mixer, and an emulsion of the hydrocarbon mixture in the aqueous acid solution was formed. The emulsion was thereafter conveyed to a decanter wherein its breaking was substantially immediately achieved, with formation of two phases as indicated in Example 1.

The nitrogen compound content of the phase containing the hydrocarbon mixture was as follows:

Total nitrogen compound content: 10.5 ppm

Basic nitrogen compound content: 1.4 ppm

The polymerized product content, according to ASTM D-381 was 17 mg/1000 ml.

The run was continued as described in Example 1, and the desulfurized feed did not contain any trace of nitrogen compound.

EXAMPLE 5

At the aspiration side of a centrifugal pump, there was simultaneously introduced:

- a hydrocarbon mixture, whose characteristics are indicated in Table VI, having a total nitrogen compound content of 23 ppm including 12 ppm of basic nitrogen compounds, and
- an aqueous sulfuric acid solution having an acid concentration of 0.2% by volume.

TABLE VI

| Feed Characteristics | |
|---|---|
| Distillation ASTM D 86 | |
| Initial point | 180° C. |
| End point | 261° C. |
| Specific gravity 15/4° C. | 0.820 |
| Composition | |
| Paraffins (vol. %) | 80 |
| Olefins (vol. %) | trace |
| Aromatics (vol. %) | 20 |

The volume ratio of the hydrocarbon mixture to the aqueous acid solution was 1/1.

The rotating speed of the pump was of 1450 rpm.

Both liquids were intimately mixed inside the centrifugal pump, and an emulsion of the hydrocarbon mixture in the aqueous acid solution was formed. The centrifugal pump pumped this emulsion to a decanter wherein the rupture of the emulsion was substantially immediately achieved with formation of two phases as described in Example 1.

The contact time between the two liquids was estimated by the time required to pass through the pump, i.e. 1 second.

The nitrogen compound content of the phase containing the hydrocarbon mixture was as follows:

Total nitrogen compound content: 6 ppm

Basic nitrogen compound content: 0.5 ppm.

This purified feed was thereafter submitted to a hydrodesulfurization treatment under the operating conditions described in Example 1. In the desulfurized hydrocarbon mixture, no trace of nitrogen compounds was detected.

EXAMPLE 6

At the aspiration side of a centrifugal pump, there was simultaneously introduced:

- a hydrocarbon mixture, whose characteristics are indicated in Table VII, having a total nitrogen compound content of 61.3 ppm, including 43.4 ppm of basic nitrogen compounds, and
- an aqueous sulfuric acid solution having an acid concentration of 0.9% by volume.

TABLE VII

| Feed Characteristics | |
|---|---|
| Distillation ASTM D 86 | |
| Initial point | 54° C. |
| End point | 203° C. |
| Specific gravity 15/4° C. | 0.793 |
| Composition | |
| Paraffins (vol. %) | 27.5 |
| Olefins (vol. %) | 33.0 |
| Naphthenes (vol. %) | 3.5 |
| Aromatics (vol. %) | 36.0 |

The volume ratio of the hydrocarbon mixture to the aqueous acid solution was 1/1. The pH of the aqueous acid solution was 1.1.

An emulsion of the hydrocarbon mixture in the aqueous acid solution was formed as described above. The emulsion ws conveyed to a decanter wherein breaking of the emulsion was substantially immediately achieved with formation of two phases, the upper phase containing the purified hydrocarbons and the lower phase containing the used aqueous acid solution.

According to the process of the present invention, 92.5% by volume of the used aqueous acid solution was recycled to the aspiration side of the centrifugal pump. The remainder of the used acid was withdrawn as a purge. A fresh aqueous acid solution was introduced into the recycle line in order to maintain the volume ratio of the hydrocarbon mixture to the aqueous acid solution at the initial value of 1/1. The amount of fresh acid added was selected to maintain the pH at a value of 1.0. This amount was 330 ml of $H_2SO_4/m^3$ of feed.

The phase containing the treated hydrocarbons was analyzed to determine its basic nitrogen compound content, and the result was 1.5 ppm.

EXAMPLE 7

The feed described in Example 6 was treated under the following operating conditions:

recycle rate: 92.5% by volume volume ratio of hydrocarbons to aqueous $H_2SO_4$ solution: 4 pH of aqueous $H_2SO_4$ solution: 0.9. The amount of fresh $H_2SO_4$ added to maintain this pH was 400 $ml/m^3$ of feed.

The phase containing the treated hydrocarbons was analyzed to determine its basic nitrogen compound content, and the result was 1.9 ppm.

EXAMPLE 8

The feed described in Example 6 was treated under the following operating conditions:

recycle rate: 92.5% by volume volume ratio of hydrocarbons to aqueous $H_2SO_4$ solution: 1 pH of aqueous $H_2SO_4$ solution: 1.5

The amount of fresh $H_2SO_4$ added to maintain this pH was 250 $ml/m^3$ of feed.

The phase containing the treated hydrocarbons was analyzed to determine its basic nitrogen compound content, and the result was 1.96 ppm.

By way of comparison, the foregoing experiment was repeated but with a recycle rate of 97.5% by volume; the other conditions being identical. The amount of fresh $H_2SO_4$ added to maintain the pH was 150 $ml/m^3$ of feed. The content of basic nitrogen compounds which remained in the treated hydrocarbons was 11.2 ppm, which value is unacceptable.

In an attempt to improve the nitrogen compound removal at high recycle rates, the amount of fresh acid added was increased and the pH was decreased with the following results:

| pH | Fresh $H_2SO_4$ consumption ($ml/m^3$ of feed) | Basic nitrogen compounds content (ppm) |
|---|---|---|
| 1 | 320 | 9 |
| 0.5 | 600 | 7 |
| 0.1 | 820 | 6 |

These results show that with too high of a recycle rate, a sufficient amount of basic nitrogen compounds is not extracted in order to reach the desired content, even if the pH is considerably reduced.

EXAMPLE 9

The feed described in Example 6 was treated under the following operating conditions:

recycle rate: 85% by volume volume ratio of hydrocarbons to aqueous $H_2SO_4$ solution: 1 pH of aqueous $H_2SO_4$ solution: 1.5

The amount of fresh $H_2SO_4$ added to maintain this pH was 310 $ml/m^3$ of feed.

The phase containing the treated hydrocarbons was analyzed to determine the basic nitrogen compound content, and the result was 0.9 ppm.

EXAMPLE 10

The feed described in Example 6 was treated using an aqueous hydrochloric acid solution having a pH of 1.45. Other operating conditions were as follows:

recycle rate: 92.5% by volume volume ratio of hydrocarbons to aqueous HCl solution: 3

The amount of fresh HCl added to maintain this pH was 300 $ml/m^3$ of feed.

The phase containing the treated hydrocarbons was analyzed to determine its basic nitrogen compound content, and the result was 1.9 ppm.

From the examples it can be seen that the process of the invention provides a highly effective way of removing nitrogen compounds from a hydrocarbon mixture in order to render the mixture suitable for reforming or other treatment, while at the same time the process of the invention avoids formation of substantial amounts of polymerized material in the hydrocarbon mixture and also consumes only a relatively small amount of acid.

The foregoing description and examples have been set forth merely to illustrate the invention, and are not intended to be limiting. Since modifications of the disclosed embodiments incorporating the spirit and substance of the invention may occur to persons skilled in the art, the scope of the invention is to be limited solely with respect to the appended claims and equivalents.

I claim:

1. A process for removing nitrogen impurities from a mixture of liquid hydrocarbons containing polymerizable unsaturated hydrocarbons, which process comprises the steps of:

continuously introducing a dilute aqueous acid solution into a low volume mixer, said solution having an acid concentration of from 0.01 to 5 volume percent;

continuously introducing the mixture of liquid hydrocarbons into said mixer, the volume ratio of the amount of liquid hydrocarbons to the amount of aqueous acid solution being from about 0.3 to about 13;

forming in the mixer an emulsion of the hydrocarbons in said aqueous acid solution by mixing during a period of time not exceeding 2 seconds the acid solution and the hydrocarbons, thereby extracting the major part of the nitrogen impurities;

withdrawing the resultant emulsion into a decantation zone where the emulsion breaks and phase separation occurs;

recovering the hydrocarbon phase containing not more than 2 ppm of basic nitrogen impurities from the decantation zone;

recycling from 80 to 95% by volume of the used aqueous acid solution phase to the low volume mixer;

withdrawing the remainder of said used aqueous acid solution phase as a purge; and adding a sufficient volume of fresh acid solution in order to maintain in the low volume mixer the volume ratio of the liquid hydrocarbon mixture to the aqueous acid solution at its initial value, the concentration of said fresh acid solution being such that the pH of the aqueous acid solution is from about 0.1 to about 1.5.

2. A process according to claim 1, wherein the liquid hydrocarbon mixture comprises hydrocarbons having a boiling point in the range from 30° to 300° C.

3. A process according to claim 1 or 2, wherein the hydrocarbon mixture is a straight run distillate.

4. A process according to claim 1 or 2, wherein the hydrocarbon mixture is obtained by thermal or catalytic cracking of heavier hydrocarbons.

5. A process according to claim 4, wherein the hydrocarbon mixture contains unsaturated hydrocarbons and has a boiling point in the gasoline range.

6. A process according to claim 1, wherein the hydrocarbon mixture is treated by means of an aqueous solution of an acid selected from the group consisting of hydrochloric acid, hydrobromic acid, hydrofluoric acid, hydroiodic acid, sulfuric acid, phosphoric acid, boric acid, fluorosulfuric acid, trifluoroacetic acid, trichloroacetic acid, formic acid, alkane sulfonic acids and alkyl benzene sulfonic acids.

7. A process according to claim 6, wherein the aqueous solution has an acid concentration of from 0.01 to 2.5% by volume.

8. A process according to claim 1, wherein from 90 to 93 volume percent of the used aqueous acid solution is recycled to the low volume mixer.

9. A process according to claim 1 or 8, wherein the pH of the aqueous acid solution introduced into the mixer is maintained from about 0.5 to about 1.

10. A process according to claim 1 or 8, wherein the volume ratio of the liquid hydrocarbon mixture to the aqueous acid solution is from about 0.5 to about 4.

11. A process according to claim 6, wherein said acid is selected from the group consisting of sulfuric acid and hydrochloric acid.

12. A process according to claim 1 further comprising the step of subjecting the hydrocarbon phase recovered from the decantation zone to hydrogenation treatment to remove residual nitrogen impurities.

13. A process according to claim 1, wherein said low volume mixer comprises a centrifugal pump.

14. A process according to claim 1, wherein said low volume mixer comprises a static mixer.

* * * * *